US006590329B2

(12) United States Patent
Tagami

(10) Patent No.: US 6,590,329 B2
(45) Date of Patent: Jul. 8, 2003

(54) DEFLECTION YOKE WITH A LOW POWER CONSUMPTION

(75) Inventor: Etsuji Tagami, Takatsuki (JP)

(73) Assignee: Matsushita Electric Industrial Co., Ltd, Osaka-Fu (JP)

( * ) Notice: Subject to any disclaimer, the term of this patent is extended or adjusted under 35 U.S.C. 154(b) by 75 days.

(21) Appl. No.: 09/922,038

(22) Filed: Aug. 3, 2001

(65) Prior Publication Data

US 2002/0014826 A1 Feb. 7, 2002

(30) Foreign Application Priority Data

Mar. 8, 2000 (JP) ..... 2000-235441

(51) Int. Cl.[7] ..... H01J 29/70; H01J 29/76

(52) U.S. Cl. ..... 313/440; 313/441; 335/209; 335/210; 335/213; 335/214; 335/299

(58) Field of Search ..... 313/440, 441; 335/210, 211, 212, 213, 214, 299; 348/829

(56) References Cited

U.S. PATENT DOCUMENTS

| | | | |
|---|---|---|---|
| 4,937,931 | A | 7/1990 | Jacobs et al. |
| 5,506,469 | A | 4/1996 | Vink et al. |

FOREIGN PATENT DOCUMENTS

| | | |
|---|---|---|
| JP | 5217518 | 8/1993 |
| JP | 2849612 | 11/1998 |
| JP | 11167882 | 6/1999 |

*Primary Examiner*—Nimeshkumar D. Patel
*Assistant Examiner*—Sharlene L Leurig

(57) ABSTRACT

To realize an energy-efficient color cathode-ray tube, deflection power requirement is reduced for a deflection yoke that includes one or more bend-up-less saddle type coils in at least one of a horizontal deflection coil and a vertical deflection coil, without changing a basic setting. To do so, a protruding part is provided which protrudes towards an electron gun at an electron gun-side bend part of a horizontal deflection coil of a bend-up-less saddle shape. Each side of the protruding part, in a direction perpendicular to the tube axis, is located at a point so that a vertical line drawn from the point to a tube axis forms an angle $\alpha$ of 10° to 50° inclusive with a vertical plane.

8 Claims, 9 Drawing Sheets

DEFLECTION YOKE WITH A LOW POWER CONSUMPTION

BACKGROUND OF THE INVENTION (1) Field of the Invention

The present invention relates to a deflection yoke of a cathode ray tube used for televisions and computer displays, and in particular to a deflection yoke having a bend-up-less saddle-type deflection coil as a horizontal or vertical deflection coil.

(2) Related Art

As an image display device in computers and televisions, a color cathode ray tube with a deflection yoke provided around a funnel has been widely used.

A general deflection yoke includes a pair of horizontal coils around the funnel, a pair of vertical coils on a funnel-shaped insulating frame positioned over the horizontal coils, and a coned ferrite core covering an outer surface of the vertical coils.

The pair of horizontal coils is positioned so that their windows face with each other in a vertical direction across a horizontal plane that includes a tube axis. Each horizontal deflection coil is symmetrical with respect to a vertical plane that includes the tube axis. The horizontal coils generate vertical magnetic fields to horizontally deflect electron beams. Also, the pair of the vertical coils is positioned so that their windows face with each other in a horizontal direction across the vertical plane that includes the tube axis. Each vertical deflection coil is symmetrical with respect to the horizontal plane that includes the tube axis. The vertical coils generate horizontal magnetic fields to vertically deflect electron beams. In this specification, "vertical direction" and "horizontal direction" refer to a vertical direction (a Y-axis direction) and a horizontal direction (an X-axis direction) of a screen of a cathode-ray tube. Also, "vertical plane" and "horizontal plane" refer to a plane extending vertically that includes the tube axis (YZ plane) and a plane extending horizontally that includes the tube axis (XZ plane).

Most of the horizontal and vertical coils are saddle-shaped coils curving substantially along the outer surface of the funnel.

As shown in FIGS. 5A, 5B and 10, a saddle-type coil includes a pair of cone parts 132 (232), a screen-side bend part 131 (231) connecting the pair of cone parts 132 (232) facing towards a screen, and an electron gun-side bend part 133 (233) connecting the pair of cone parts facing towards an electron gun.

Saddle-type coils are divided into 'bend-up' types and 'bend-up-less' types, depending on whether the electron gun-side bend part 3 protrudes or not. A saddle-type coil 111*a* as shown in FIGS. 5A and 5B is a 'bend-up-less' type in which the electron gun-side bend part 133 is extending along the outer surface of the funnel (not shown in the drawing). Meanwhile, a saddle-type coil 211 shown in FIG. 10 is a 'bend-up' type in which the electron gun-side bend part 233 protrudes (extends away) from the outer surface of the funnel.

The 'bend-up-less' saddle-type coil has the electron gun-side bend part extending at a position closer to the tube axis, which makes it easy to suppress the strength of magnetic fields generated near the electron gun-side bend part. This means that the use of a deflection yoke with bend-up-less saddle-type coils has an effect of forming a more preferable distribution of principal magnetic fields than when using a deflection yoke with bend-up saddle-type coils therein. This will lead to a reduction in deflection power.

In general, there is a demand to lower power consumption of electric appliances. Accordingly, a reduction in deflection power consumption is required for color cathode-ray tubes having deflection yokes with the 'bend-up-less' saddle-type coils.

Given the fact that deflection power is reduced as the distance between electron beams and coils or between the electron beams and the ferrite core is shorten, the deflection power can be reduced by making the horizontal coils and the vertical coils as thin as possible and setting the internal diameter of the ferrite core as short as possible.

In designing the bend-up-less saddle-type coils, however, a distribution of principal deflection magnetic fields largely determines the shape and number of turns of the coils and the coils that are commonly used do not vary much in diameter. For these reasons, the thickness of the coils is predetermined in effective.

For instance, in the electron gun-side bend part 133 of FIGS. 5A and 5B, the front-end location for a front part of the electron gun-side bend part 133 (an end facing towards the screen, which is represented by coordinate Z1 in FIGS. 5A and 5B) and the back-end location for a back part of the electron gun-side bend part (an end facing towards the electron gun, which is represented by coordinate Z2 in FIGS. 5A and 5B) serve as parameters in determining a distribution of principal deflection magnetic fields and a deflection center in the deflection yoke. The distribution in turn determines a raster characteristic and neck shadow tolerance of a color cathode-ray tube (coordinate Z1 and Z2 shown in FIGS. 5A and 5B are taken along the tube axis. The origin (Z=0) is taken so as to correspond with a point on a reference line, with a plus region being on the side of the screen and a negative region being on the side of the electron gun).

Therefore, if, in designing the deflection yoke, an optimal raster characteristic and a neck shadow tolerance are considered for each shape of funnels, the front-end location Z1 and the back-end location Z2 will be determined accordingly.

When the front-end location Z1, the back-end location Z2 and the number of turns of the coils are determined, a minimum thickness of the coils of the electron gun-side bend part 133 is determined. For instance, if n1 of copper wires having an outer diameter of 2r are wound n2 times, the number of turns of the copper coil to be obtained is $n1 \cdot n2$. Thus, the gross cross section area of the copper wires at the electron gun-side bend part 133 is $\pi r^2 \times n1 \cdot n2$ and the thickness of the electron gun-side bend part 133 exceeds $\pi r^2 \times n1 \cdot n2/(Z2-Z1)$.

SUMMARY OF THE INVENTION

To realize an energy-efficient color cathode-ray tube, deflection power is reduced for a deflection yoke that includes one or more bend-up-less saddle type coils in at least one of a horizontal deflection coil and a vertical deflection coil, without changing a basic setting, which has an effect on deflection, such as a cross section area of the cone parts and a deflection center location. To do so, a horizontal deflection coil of a bend-up-less saddle shape has a protruding part protruding towards an electron gun at an electron gun-side bend part. Each side of the protruding part in a direction perpendicular to the tube axis is located at a point so that a vertical line drawn from the point to a tube axis forms an angle $\alpha$ of 10° to 50° inclusive with a vertical plane.

The ends of the protruding part in a direction perpendicular to the tube axis are the widest, and the bottom part of the protruding part is usually the widest. Therefore, the word "side of the protruding part in a direction perpendicular to the tube axis" refers to the bottom side of the protruding part, in other words, a point where the protruding part begins.

With this construction, the thickness of the coils of the electron gun-side bend part is reduced by the amount of the protruding part. The smaller the thickness of the electron gun-side bend part becomes, the smaller an inside diameter of the deflection yoke core can be, which covers the electron gun-side bend part. This will result in reducing deflection power requirement.

The protruding part is created only in an area where an angle formed between the vertical plane and the perpendicular line drawn to the tube axis is no greater than 50°, the position of the front-end location Z1 and back-end location Z2 of the electron gun-side bend part and the pattern of magnetic fields generated by the coils are not affected by whether the protruding part is created or not.

For a vertical deflection coil having a bend-up-less saddle shape, the protruding part can be formed at the electron gun-side bend part so that the protruding part protrudes towards the electron gun and that each side of the protruding part that is perpendicular to the tube axis is located at a point such that a perpendicular line drawn from the point to the tube axis forms an angle of 10° to 50° with a horizontal plane.

As the horizontal deflection coil experiences, thickness of the electron gun-side bend part of the vertical deflection coil can be reduced, and thus the deflection power can be reduced while maintaining the front-end location Z1 and back-end location Z2 of the electron gun-side bend part at the same position as they are when the protruding part is not created.

Such a protruding part can be easily formed by press molding a part of the horizontal or vertical deflection coil.

It is preferable that the protruding part has a rectangular shape and is no less than 3 mm in length.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF PREFERRED EMBODIMENTS

Figure 1:
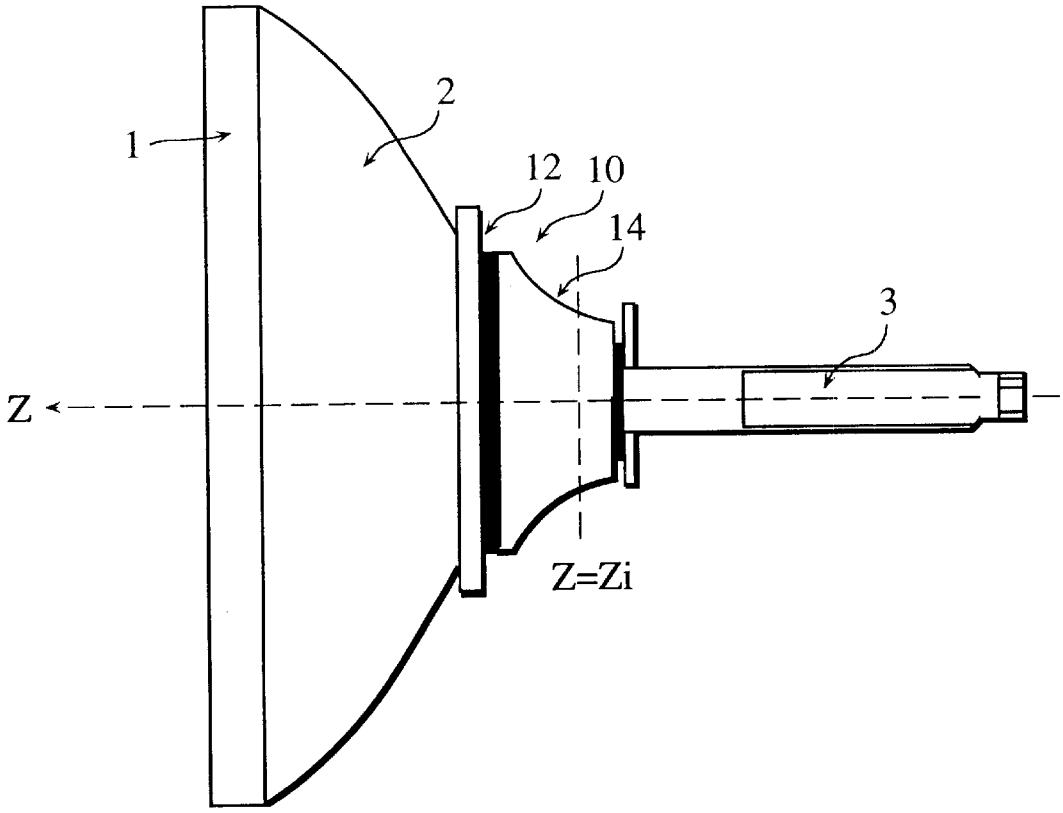
FIG. 1 is a view of a color cathode-ray tube in an embodiment of the present invention.

FIG. 1 is a view of a color cathode-ray tube in an embodiment of the present invention.

The color cathode-ray tube includes an evacuated envelope which includes a front panel 1 having a phosphor screen on an inner surface and a funnel 2, an electron gun 3 provided inside a neck of the funnel 2 for generating electron beams towards the front panel 1, a deflection yoke 10 provided around the funnel 2.

The funnel 2 is funnel-shaped. While the neck of the funnel 2 has a circular cross-section, a cone part of the funnel 2 has a substantially rectangular cross-section.

Figure 2:
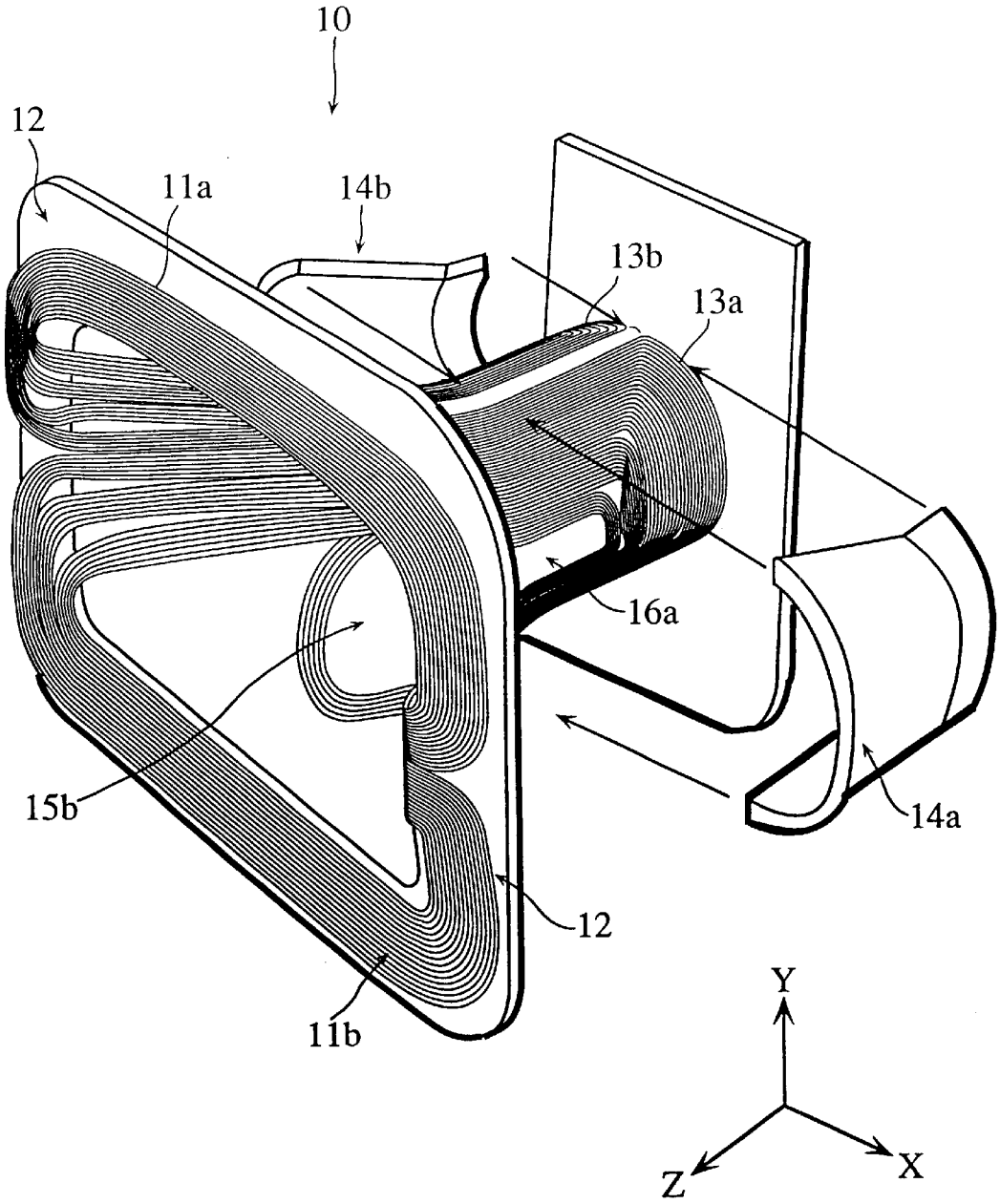
FIG. 2 is a perspective view showing the construction of a deflection yoke used in the color cathode-ray tube.

FIG. 2 is a perspective view showing the construction of the deflection yoke 10.

Figure 3A:
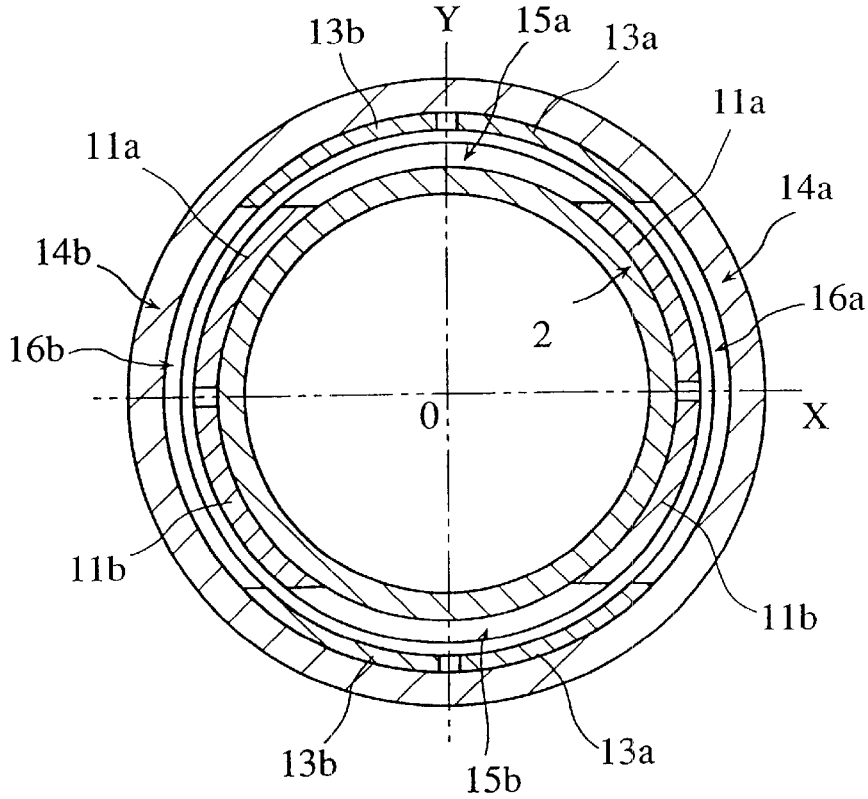
FIGS. 3A and 3B are cross-sections XY of the color cathode-ray tube taken perpendicular to the tube axis.
Figure 3B:
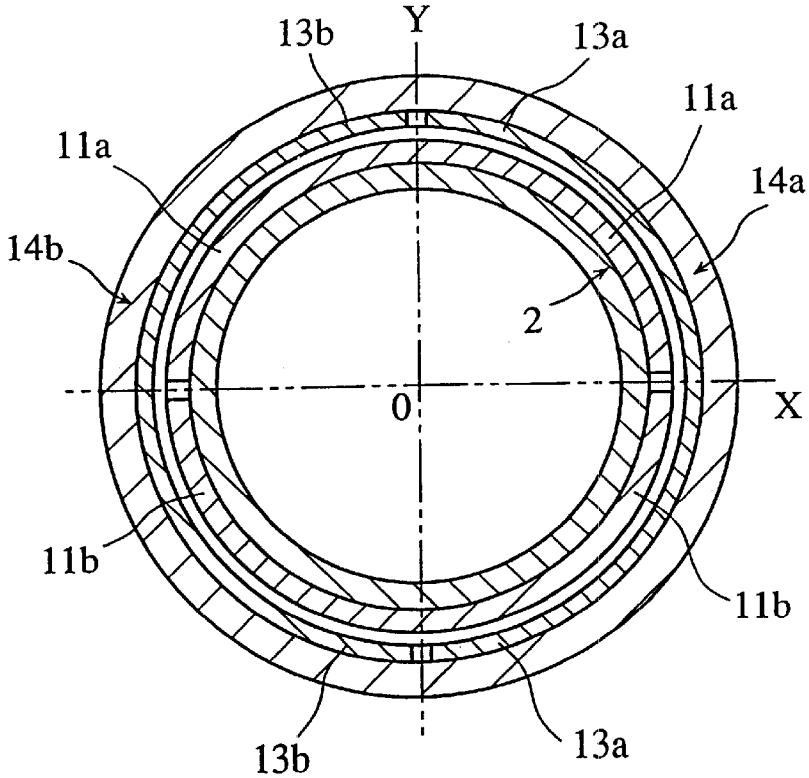

FIGS. 3A and 3B show cross-sections XY, taken in a direction perpendicular to a tube axis (Z-axis) of the color cathode-ray tube which has the deflection yoke 10. FIG. 3A is a cross-section taken at a position closer to the neck from the center of the deflection yoke 10 (which corresponds with a location of a cone part, as explained later, and is shown as Z=Zi in FIG. 1) and FIG. 3B is a cross-section taken at a position much closer to the neck from the center of the deflection yoke 10 (which corresponds with a location of an electron gun-side bend part as explained later). Here, X-axis is a horizontal axis and Y-axis is a vertical axis.

The deflection yoke 10 includes horizontal coils 11, an insulating frame (a coil separator) 12, vertical coils 13 and a ferrite core (a deflection yoke core) 14 situated in this order from the center (the funnel 2) to the outside.

The deflection yoke 10 is provided on the border between the neck and the cone part of the funnel 2 to produce magnetic fields inside the funnel 2. The funnel 2 has a circular cross-section at a position where the deflection yoke 10 is provided.

The insulating frame 12 is a plate insulator (a plastic compact) molded into the form of a funnel so as to fit a portion of the funnel 2 at which the deflection yoke 10 is provided. The thickness of the insulating frame 12 is almost the same everywhere.

Horizontal deflection coils 11 and vertical deflection coils 13 are mounted on the interior and exterior surface of the insulating frame 12, respectively. The insulating frame 12 is positioned between the coils 11 and 12 to insulate the coils 11 and 12.

The horizontal deflection coils 11 are made up of a pair of horizontal coils 11*a* and 11*b*, each of them having wires wound into the form of a saddle. The horizontal coils 11*a* and 11*b* are arranged along the inside surface of the insulating frame 12 so that a window 15*a* of the coil 11*a* and a window 15*b* of the coil 11*b* face with each other vertically (in the direction of Y-axis).

Likewise, the vertical deflection coils 13 are made up of a pair of vertical coils 13*a* and 13*b*, each having wires wound into the form of a saddle. The vertical coils 13*a* and 13*b* are arranged along the outer surface of the insulating frame 12 so that a window 16*a* of the vertical deflection coil 13*a* and a window 16*b* of the vertical deflection coil 13*b* face with each other horizontally (in the direction of X-axis).

Details of the horizontal coils 11*a* and 11*b* and the vertical coils 13*a* and 13*b* are explained hereafter.

A ferrite core 14 is a coned cylinder, situated outside of the vertical deflection coils 13 so as to cover the horizontal deflection coils 11 and the vertical deflection coils 13. The ferrite core 14 is a little shorter in the direction of the tube axis (Z-axis direction) than the insulating frame 12.

As shown in FIG. 2, the ferrite core 14 is made up of a combination of symmetrical semicircle ferrite cores 14*a* and 14*b*.

In the deflection yoke 10, when a high-frequency wave of 15.743 kHz is applied to the horizontal deflection coils 11, a sawtooth horizontal deflection current is energized. The horizontal deflection coils 11 then generate vertical magnetic fields in the funnel 2, which vertical magnetic fields horizontally deflect electron beams emitted from the electron gun 3. When a high-frequency wave of 59.94 Hz is applied to the vertical deflection coils 13, a sawtooth vertical deflection current is energized. The vertical deflection coils 13 then generate horizontal magnetic fields in the funnel 2, which horizontal magnetic fields vertically deflect electron beams emitted from the electron gun 3.

The ferrite core 14 produces a magnetic core or magnetic circuit for deflection magnetic fields generated in the horizontal deflection coils 11 and vertical deflection coils 13.

When the electron beams emitted from the electron gun 3 pass through the funnel 2, they are deflected horizontally or vertically by the magnetic fields generated from the deflection yoke 10. The magnetic fields control landing of the electron beams on the phosphor screen, and a specified raster is obtained.

(Characteristics of the Shape of the Horizontal Deflection Coils and the Vertical Deflection Coils)

The following is a detailed explanation of the horizontal coils 11*a* and 11*b* and the vertical coils 13*a* and 13*b*.

To explain the horizontal coils 11*a* and 11*b*, the horizontal deflection coil 11*a* is taken as an example.

Figure 4A:
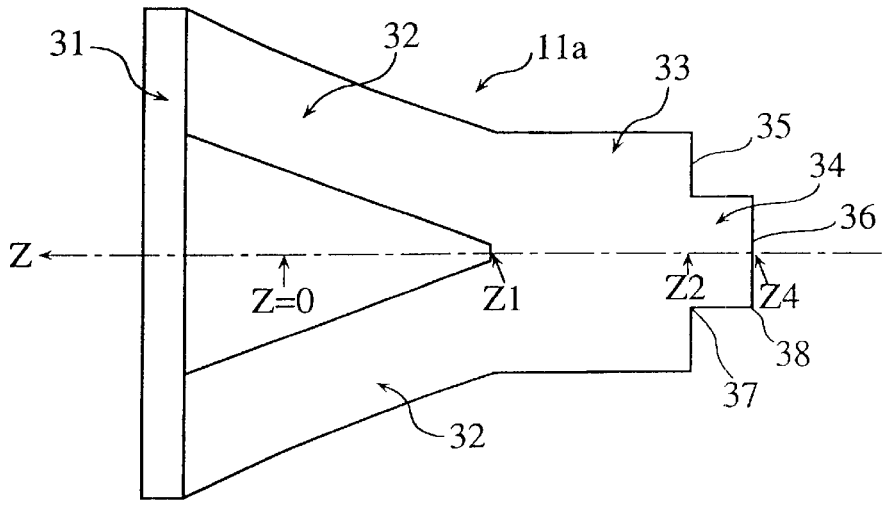
FIGS. 4A and 4B are a top view and a side view of a horizontal deflection coils in the embodiment of the present invention.
Figure 4B:
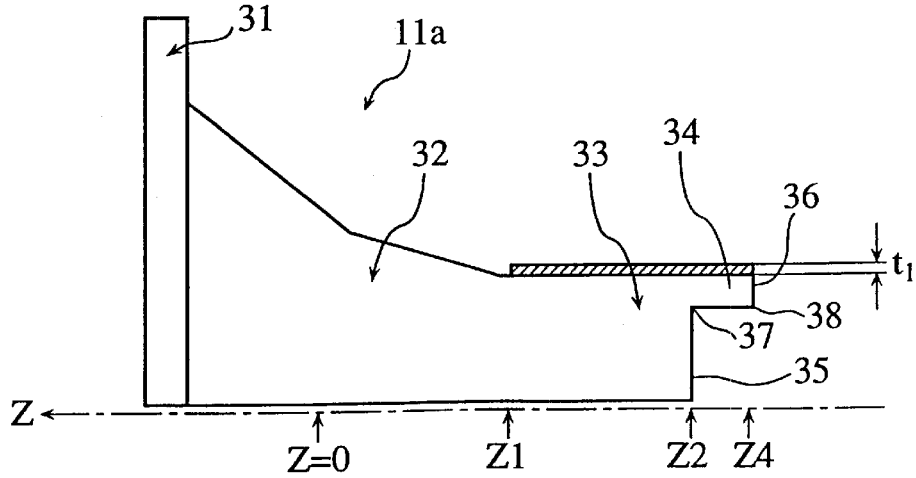

FIG. 4A is a top view and FIG. 4B is a side view of the horizontal deflection coil 11*a*.

The horizontal deflection coil 11*a* is a so-called bend-up-less saddle-type coil, made up of a pair of cone parts 32, a screen-side bend part 31 connecting the pair of cone parts 32 facing towards the screen, and an electron gun-side bend part 33 connecting the pair of cone parts facing towards the electron gun.

The vertical deflection coils 13*a* and 13*b* are shaped like a bend-up-less saddle as the horizontal deflection coil 11*a* is, which coils include a screen-side bend part, a pair of cone parts and an electron gun-side bend part.

The cone part 32 has wires extending along the tube axis, and the cone part is almost entirely covered with the ferrite core 14. The electron gun-side bend part 33 has wires extending along plane XY, which wires are in most part covered with the ferrite core 14. The wires protrude 10~20 mm from the ferrite core 14 towards the electron gun 3 in the direction of the tube axis.

In the horizontal coils 11*a* and 11*b*, a protruding part 34 is formed at the electron gun-side bend part 33, protruding towards the electron gun.

Figure 6A:
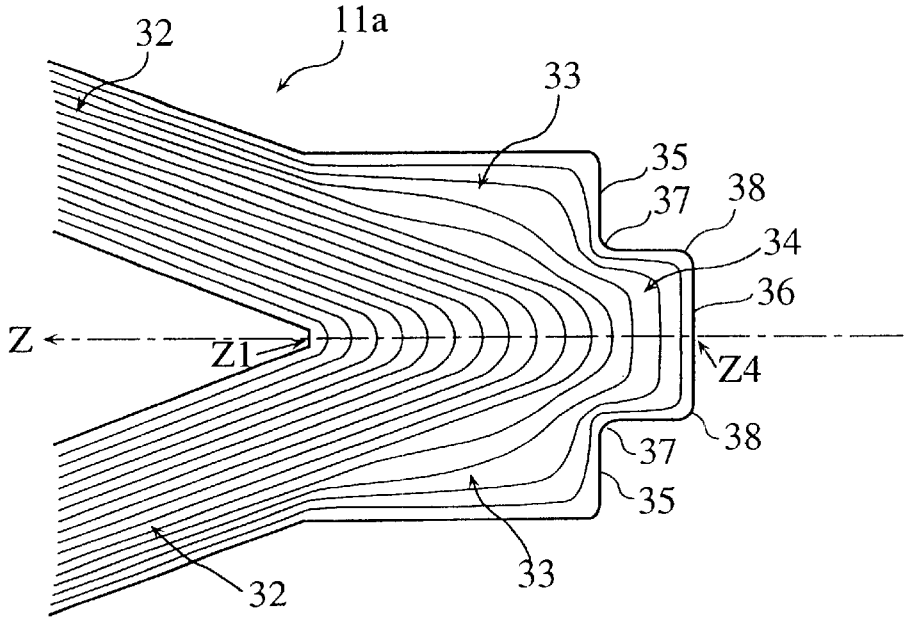
FIGS. 6A and 6B are schematic diagrams showing coils at an electron gun-side bend part of the horizontal deflection coil in the embodiment and comparative example.

FIG. 6A is a schematic diagram showing wires at the electron gun-side bend part 33 of the horizontal deflection coil 11*a*.

The protruding part 34 is formed by transforming part of the wires at the electron gun-side bend part 33 (especially those situated nearer to the electron gun) so that the wires protrude towards the electron gun.

Figure 7:
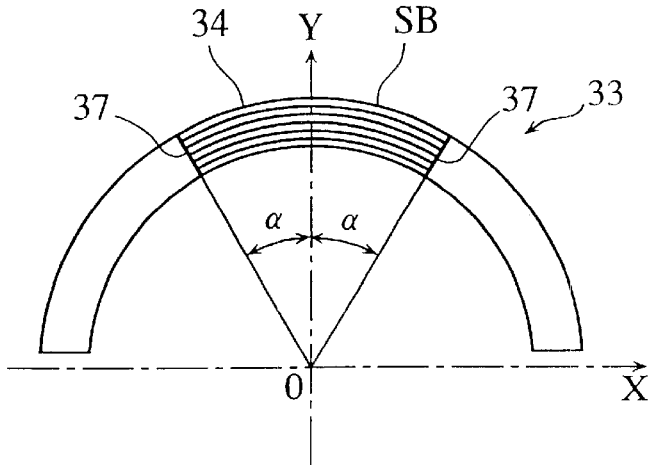
FIG. 7 shows the electron gun-side bend part of the horizontal coils as viewed from the electron gun side related to the embodiment.

FIG. 7 is a view of the electron gun-side bend part 33 of the horizontal deflection coil 11*a* as seen from the side of the electron gun.

As shown in FIGS. 4A and 7, the electron gun-side bend part 33 is symmetrical with respect to a vertical plane that includes the tube axis (the vertical plane corresponds with Z-axis of FIG. 4A and Y-axis of FIG. 7). As shown in FIG. 7, it is a semicircle symmetrical with respect to the vertical plane that includes the tube axis (Y-axis) as seen from the side of the electron gun.

The protruding part 34 is formed such that it is symmetrical with respect to the vertical plane in a region within a specific distance from the vertical plane. As shown in FIG. 4A, the protruding part appears rectangular as seen in a vertical direction (in Y-axis direction). However, as seen from the electron gun side, as shown in FIG. 7, it looks like an arc symmetrical with respect to a vertical plane that includes the tube axis (Y-axis direction in FIG. 7).

As shown in FIG. 4A, the electron gun-side bend part 33 has an electron gun-side end surface 35 outside of the region. The protruding part 34 protrudes from the surface of an electron gun-side end surface 35, extending towards the electron gun. In FIG. 4, the numeral 37 indicates a point from where the protruding part 34 begins. The point corresponds with the widest side of the protruding part.

Basically, the thickness of the electron gun-side bend part 33, including the protruding part 34, is equal everywhere in the direction of the tube axis, but it does not always have to be equal.

The width of the protruding part 34 is determined by an angle $\alpha$ that is formed between a vertical plane and a vertical line drawn from the point 37 to the tube axis. The angle $\alpha$ is in a range of 10° to 50° inclusive ($10° \leqq \alpha \leqq 50°$) In FIG. 7, the angle $\alpha$ is 30°.

The electron gun-side end surface 35 and an electron gun-side end surface 36 of the protruding part 34, shown in FIGS. 4A and 4B, are flat planes perpendicular to the tube axis, but they may have a curved surface.

As shown in FIG. 6A, none of the four corners of the protruding part 34 has a right angle. It is curving with a curvature radius R.

(Effect of Forming the Protruding Part 34)

By forming the protruding part 34 at the horizontal deflection coil 11*a*, the electron gun-side bend part 33 can be made thinner and deflection power can be reduced. This is explained in the following with reference to a comparative example.

Figure 5A:
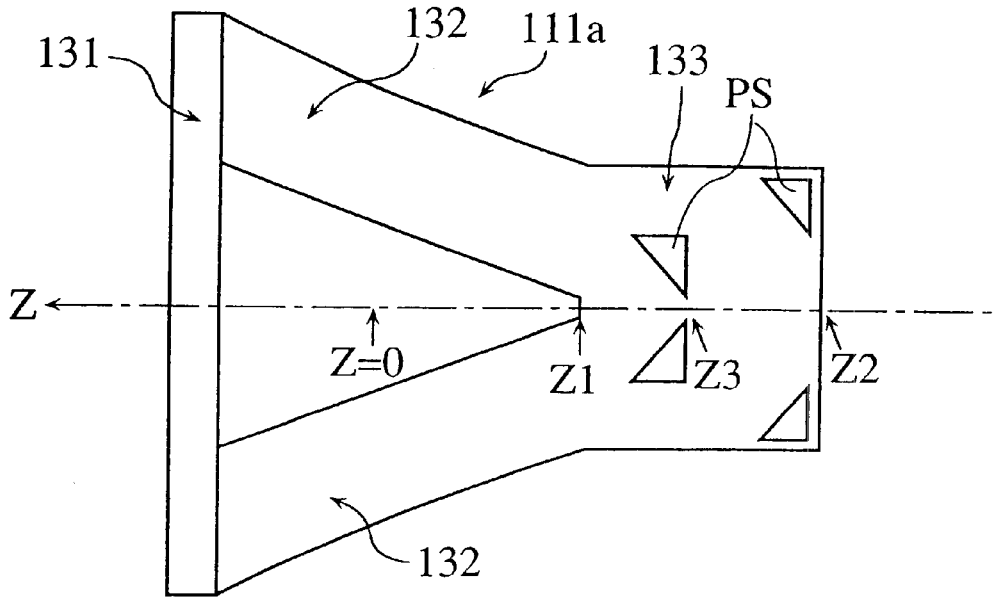
FIGS. 5A and 5B are a top view and a side view of the horizontal deflection coils in a comparative example.
Figure 5B:
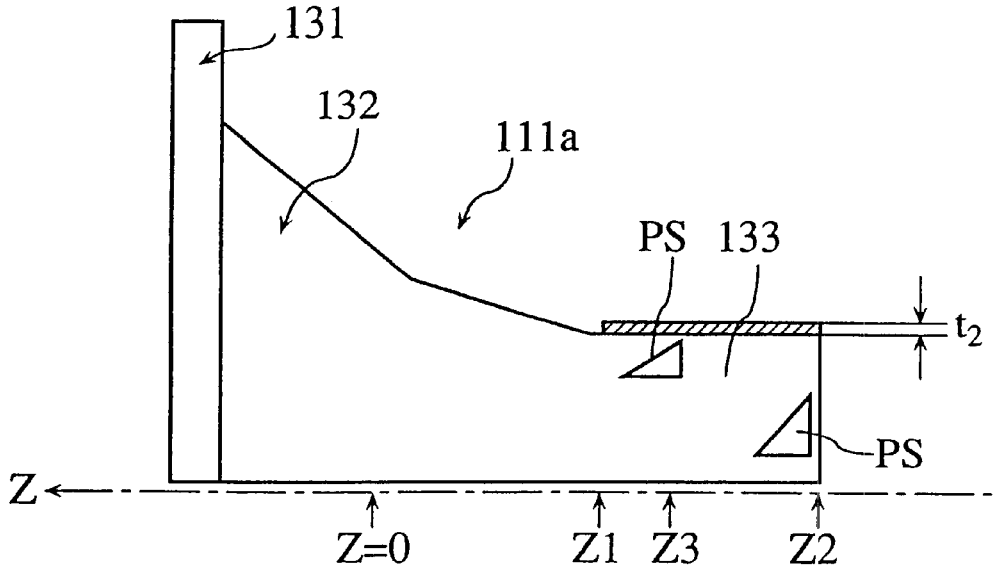

FIGS. 5A and 5B are a top view and a side view of a horizontal deflection coil 111*a* related to a comparative example that does not have a protruding part.

In the electron gun-side bend part 133, there are pin shooting spaces PS. In forming a coil using a metal mold, pins are inserted into the metal mold during winding wires in order to adjust the shape of the coil.

The pin shooting spaces PS are created at places where the pins are inserted.

Figure 6B:
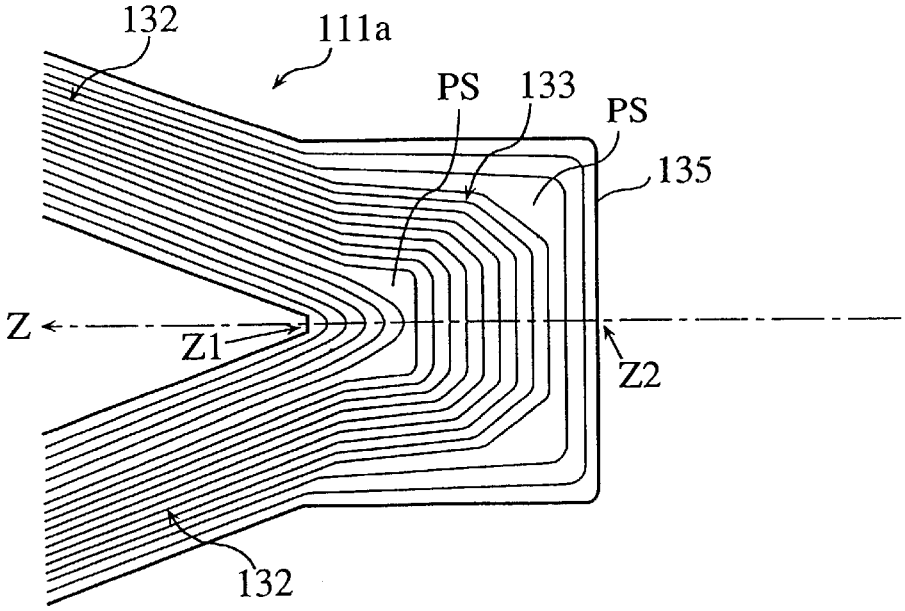

FIG. 6B is a schematic diagram of wires at an electron gun-side bend part 133 of the horizontal deflection coil 111*a* in the comparative example.

The shape and the number of turns of the coils at the cone part 132 and a screen-side bend part of the horizontal deflection coil 111*a* are the same as those of the horizontal deflection coil 11*a*.

The front-end location Z1 of the electron gun-side bend part 133 corresponds with the front-end location Z1 of the electron gun-side bend part 33, whereas the back-end location Z2 of the electron gun-side bend part 133 corresponds to the location Z2 for the electron gun-side end surface 35 of the electron gun-side bend part 33.

The following describes the thickness of the electron gun-side bend part of the horizontal deflection coil 11*a* in this embodiment in comparison with that of the horizontal deflection coil 111*a* in the comparative example.

Having the same number of turns of the coils, the electron gun-side bend parts 33 and 133 have almost the same volume. This makes the electron gun-side bend part 33 with the protruding part 34 thinner than the electron gun-side bend part 133 by the amount equivalent to the volume of the protruding part 34.

The following describes another point of view about the comparison.

Having the same number of turns of the coils at the electron gun-side bend part, the thickness of the electron gun-side bend part decreases as the width of the electron gun-side bend part, in the direction of the tube axis, increases.

The electron gun-side bend part 33 with the complexity 34 (in FIG. 6A) is longer than the comparative example (in FIG. 6B) without the complexity by the length of the complexity extending along the tube axis, and the coils of the electron gun-side bend part 33 is thinner than the electron gun-side bend part 33.

Figure 8A:
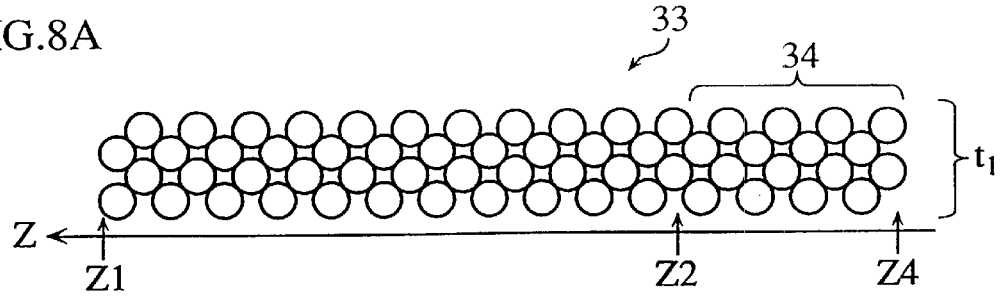
FIGS. 8A and 8B are schematic diagrams showing a cross-section of the electron gun-side bend part, on a vertical plane that includes the tube axis, in this embodiment and the comparative example.
Figure 8B:
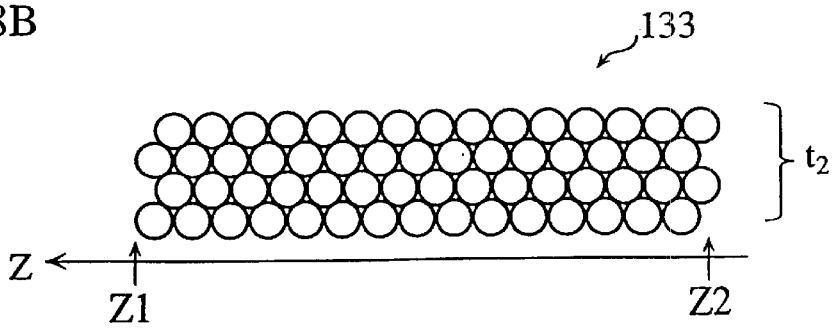

This is described in the following with reference to drawings. FIGS. 8A and 8B are schematic diagrams showing a cross-section of the electron gun-side bend part 33 and a cross section of the electron gun-side bend part 133 taken on a vertical plane that includes the tube axis.

FIGS. 8A and 8B show wires piled up layer by layer. The electron gun-side bend part 33 of FIG. 8A is longer in the direction of the tube axis (in a horizontal direction in FIG. 8A) than the electron gun-side bend part 133 of FIG. 8B by the length of the complexity 34. Also, horizontal gaps created between the adjacent wires are larger in the electron gun-side bend part 33 than in the electron gun-side bend part 133.

Accordingly, the vertical distance between the layers of wires is shorter in the electron gun-side bend part 33 of FIG. 8A. This means that the thickness of coils of the electron gun-side bend part 33 t1 is smaller than that of the electron gun-side bend part 133 t2.

As the thickness of coils of the electron gun-side bend part 33 becomes smaller, the diameter of the insulating frame 12 decreases at a portion surrounding the electron gun-side bend part 33. In the vertical deflection coil 13*a*, the diameter of the insulating frame also decreases at a position surrounding the electron gun-side bend part 33. Furthermore, an inner diameter of the ferrite core 14 can be reduced at a portion surrounding the electron gun-side bend part 33.

Since the electron beams pass near the tube axis, by making the vertical deflection coil 13*a* and the ferrite core 14 smaller in diameter at a portion surrounding the electron gun-side bend part 33, the distance between a pathway of the electron beams and the vertical coils and the distance between the pathway of the electron beams and an inner surface of the ferrite core are both shorten. Accordingly, magnetic resistance of the coils becomes smaller, making it possible to reduce deflection power necessary for emitting the electron beams.

As for the deflection power consumed by a deflection yoke, it in general has a correlation with the distance between the deflection coils and the pathway of the electron beams and the distance between the inner surface of the ferrite core and the pathway of the electron beams. In fact, as the distance between the inner surface of the ferrite core and the pathway of the electron beams is shorten, magnetic resistance becomes smaller, resulting in a reduction in the deflection power consumption.

As described above, the reduction in the distance between the ferrite core 14 and the pathway of the electron beams makes a considerable contribution to decreasing the deflection power consumption.

(Meaning of Defining a Location for the Protruding Part 34)

The following describes why the width of the protruding part 33 is determined such that $10° \leqq \alpha \leqq 50°$.

The distribution of principal deflection magnetic fields in the deflection coil 11*a* is largely determined by the cone part 32. The wires of the cone part 32 extend to near the location Z2 for the electron gun-side end surface 35 on the outer side (away from the vertical plane). Therefore, the electron gun-side end surface 35 must be large enough to distribute principal deflection magnetic fields as desired.

When $\alpha$ exceeds 50°, it is difficult to obtain a large enough area for the electron gun-side end surface 35. Also, principal deflection magnetic field components, which are generated from the protruding part 34, become too large to achieve a desired distribution of principal deflection magnetic fields.

As described above, in designing the deflection yoke, the front-end location Z1 and back-end location Z2 for the electron gun-side bend part 33 are determined such that a distribution of principal deflection magnetic fields are obtained with a raster characteristic and neck shadow tolerance optimal for the shape of a funnel (the neck shadow tolerance is a tolerance indicating how far the deflection yoke, when being placed around the funnel, can be situated from a predetermined point along the tube axis while producing a neck shadow. Usually, the neck shadow tolerance is about 3 mm). If the protruding part 34 extends so much that $\alpha$ exceeds 50° the area of the electron gun-side end surface 35 becomes so small that the back-end location Z2 could not be differentiated by the electron gun-side end surface 35. This is what happens when the electron gun-side bend part 33 is extended to the electron gun-side end surface 36 without creating the protruding part 34. In this case, it is impossible to obtain a desired distribution of principal deflection magnetic fields.

On the other hand, when $\alpha$ does not exceed 50°, the principal deflection magnetic fields are hardly affected by the presence of the protruding part 34. The principal deflection magnetic fields produced by the coils have almost the same pattern as they would have when the protruding part is not created. Also, the front-end location Z1 and back-end location Z2 of the electron gun-side bend part are situated at the same position as they would be when the protruding part is not created.

When $\alpha$ is not greater than 10°, since the width of the protruding part 34 is smaller, the coils of the electron gun-side bend part 33 are made smaller in a smaller area. As described above, the length of the protruding part 34 is virtually limited. If the width of the complexity 34 is so small, it is difficult to achieve an effect of reducing the deflection power.

To reduce the thickness of coils at the electron gun-side bend part 33, it is preferable to determine $\alpha$ to be no less than 10° so that the protruding part 34 has a certain width.

Figure 10:
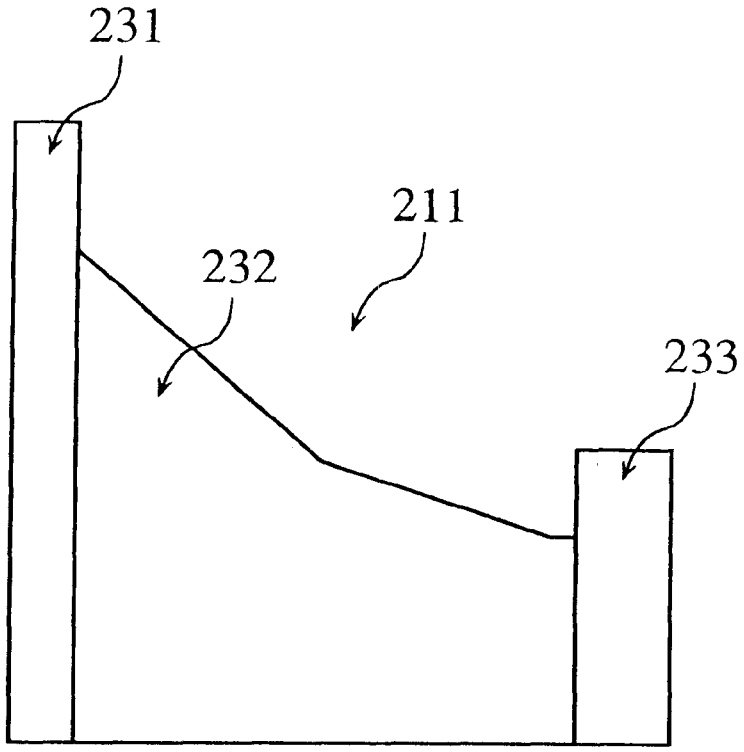
FIG. 10 is a side view of a bend-up saddle-type coil according to a conventional example.

In the case of the bend-up saddle-type coil of FIG. 10, an electron gun-side bend part 233 has an electron gun-side end raised, whose back-end is not situated at location Z2. Therefore, it is impossible for the coils, being located at other place than the back-end location Z2, to produce the same pattern of principal deflection magnetic fields as those produced by the bend-up-less coils.

(Shape and Length of the Protruding Part)

In the above description, the protruding part 34, which is formed at the electron gun-side bend part, has a rectangular shape as seen in a vertical direction. However, the protruding part 34 can have other shapes than a rectangular shape. Whether it is triangular, bell-shaped, trapezoidal or in any other form, the same effect can be obtained of reducing the thickness of coils at the electron gun-side bend part 33. When the protruding part 34 has a rectangular shape, the width of it is the same at the extreme end and at the bottom. The area of the protruding part is therefore larger than convexities in other forms, despite their having the same length and width at the bottom. This means that a rectangular protruding part can produce a larger effect of making the coils thinner at the electron gun-side bend part.

The length of the protruding part 34 is preferably determined to be no less than 3 mm in length to achieve that effect.

As the length of the protruding part 34 increases, the thickness of the coils decreases. However, due to the size of the entire color cathode-ray tube, the length of the deflection yoke has a limit and therefore the length of the protruding part 34 has a limit. Specifically, a maximum length of the protruding part 34 is a length determined when the electron gun-side end surface 36 of the protruding part is not situated beyond main lenses of the electron gun 3.

(Manufacturing Method for the Horizontal Deflection Coil 11*a*)

As shown below, the horizontal deflection coil 11*a* can be easily formed by press molding wires after winding.

Firstly, a saddle-type coil is formed using the method for forming the vertical deflection coil 113*a* of FIG. 6B. The protruding part is not created yet. The saddle-type coil is formed using a pair of metallic moulds that fit the vertical deflection coil 113*a*. This is the method for forming saddle-type coils in general. The metallic moulds are designed to have a small space in between, when fit together, at a portion covering an electron gun-side bend part of the vertical deflection coil 113*a*.

Then, the electron gun-side bend part, being made thinner, is pressed from the direction of the electron gun along the tube axis. During the press molding, the formed coil is kept inside the combined pair of metallic moulds. Here, another metal mould for press molding is used which fits the protruding part 34. These metal moulds have a curvature R in areas corresponding to the point 37 and corners 38 of the protruding part so as not to harm the coil.

During press molding, the shape of the coil is changed from FIG. 6B to FIG. 6A. Accordingly, the wires extend towards the electron gun-side part, and the protruding part 34 is formed.

In the horizontal deflection coil 11*a* of FIGS. 4A and 4B, there are no pin shooting spaces PS. This is because pins are not used for winding wires. Pins may be used for the winding. In that case, a formed coil is pressed with the pins in it, and the pin shooting spaces PS are created after the pressing. The size of the spaces PS is reduced as a result of the thickness of the coil being reduced. However, whether there are pin shooting spaces PS or not, the electron gun-side bend part 33 can be made thinner by forming the protruding part 34 at the horizontal deflection coil 11*a*.

(Application to the Vertical Coils)

The above description is about how to form the protruding part in the horizontal deflection coils 11, but the protruding part can be also formed at an electron gun-side bend part of the vertical deflection coils 13.

In forming the protruding part at the horizontal deflection coils 13*a* and 13*b*, a point from where the protruding part begins is determined according to an angle having a center at the tube axis so that a vertical line drawn from the point down to the tube axis forms an angle β with a horizontal plane such that $10° \leqq \beta \leqq 50°$.

Forming the protruding part in the vertical coils 13*a* and 13*b* is effective in reducing the thickness of the coils. Also, the protruding part does not affect the principal deflection magnetic fields generated from the coils.

Therefore, the thickness of the horizontal deflection coils 11 and the vertical deflection coils 13 can be made smaller at the electron gun-side bend part, and thereby an inner diameter of the ferrite core 14 and the deflection power can be further reduced.

Even if the convexities are formed at the vertical deflection coils 13 and not formed at the horizontal deflection coils 11, it is possible to reduce the thickness of the vertical deflection coils 13 at the electron gun-side bend part. As a result, an inside diameter of the ferrite core 14 is reduced and the deflection power is also reduced.

EXAMPLE

The embodiment and comparative example of the present invention are hereafter described in relation to a deflection yoke used for a 46-centimeter flat-screened color cathode-ray tube with a deflection angle of 100°.

The deflection yoke in this embodiment employs the horizontal deflection coil 11*a* as a horizontal deflection coil while the deflection yoke in the comparative example employs the horizontal deflection coil 111*a* as a horizontal deflection coil.

Both in the embodiment and comparative example, a front-end location Z1 for the electron gun-side bend part of the horizontal deflection coil is located such that Z=−40 mm and a back-end location Z2 is situated such that Z=−70 mm.

In this embodiment, the location for the electron gun-side end surface 36 of the protruding part 34 is determined such that Z4=−80 mm so as not to exceed the main lens of the electron gun 3 (situated at Z=90 mm). The length of the protruding part (Z2−Z4) is therefore 10 mm.

Figure 9A:
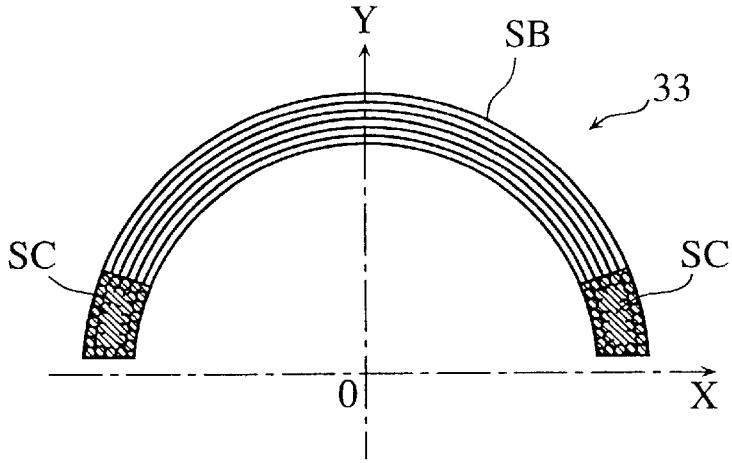
FIGS. 9A thru 9C are sectional views of the horizontal coils, on a vertical plane that includes the tube axis, in this embodiment and the comparative example.
Figure 9B:
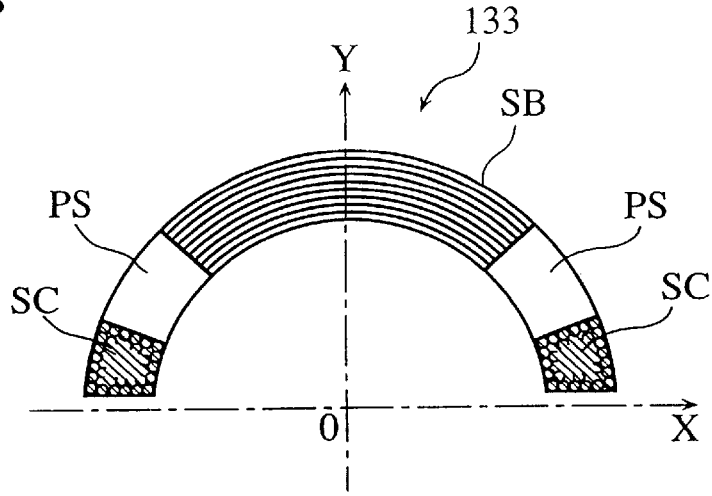

FIGS. 9A and 9B show cross-sections of the horizontal deflection coil 11*a* in the embodiment and the horizontal deflection coil 111*a* according to the comparative example taken perpendicular to the tube axis such that Z=−68 mm, which is a location near the back-end location Z2 for the electron gun-side bend part.

In the drawings, SB shows a cross-section of the bend part (in which a side view or longitudinal cross-section of the coil is visible), SC shows a cross-section of the cone part (in which a circular cross-section of the coil is visible) and PS shows pin shooting spaces.

FIG. 9B shows a cross-section of the horizontal deflection coil 111*a* according to the comparative example. The horizontal deflection coil 111*a* has an inside diameter (radius) R1 of 15.8 mm and outside diameter (radius) R2 of 20 mm. The gross cross-section area is 118 $mm^2$, of which a cross-section of the bend part SB takes up 59 $mm^2$ (50%), a cross-section of the cone part SC takes up 11.8 $mm^2$ (10%) and pin shooting spaces PS take up 47.2 $mm^2$ (40%).

FIG. 9A shows a cross-section of the horizontal deflection coil related to this embodiment. The horizontal deflection coil 11*a* has an inside diameter R1 of 15.8 mm and outside diameter R2 of 18.2 mm. The gross cross-section area is 64.1 $mm^2$, of which the cross-section of the bend part SB takes up 52.6 $mm^2$ (82%), the cross-section of the cone part SC takes up 11.5 $mm^2$ (18%).

Figure 9C:
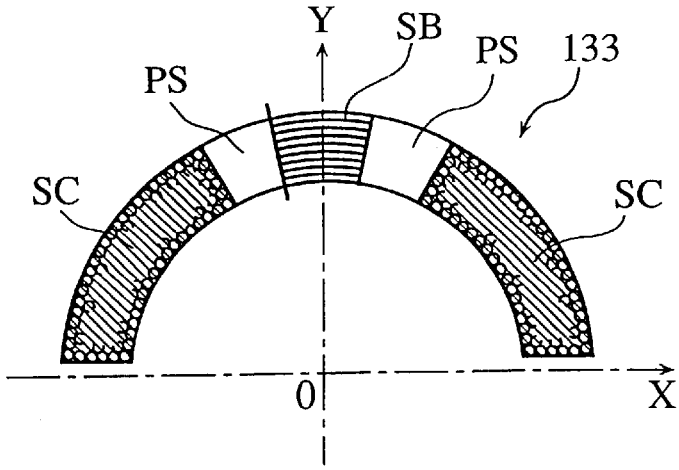

FIG. 9C shows a cross-section of the horizontal deflection coil 111*a* according to the comparative example taken perpendicular to the tube axis at a location closer to the front-end location Z1 of the electron gun-side bend part (which is Z3 of FIGS. 5A and 5B). In the cross-section, the cross-section of the cone part SC takes up 65%, cross-section of the bend part SB takes up 10% and the pin shooting spaces take up 25%.

As described above, the gross cross-section area, cross-section of the bend part SB and pin shooting spaces of the horizontal deflection coil 11*a* according to the embodiment are smaller than those of the horizontal deflection coil 111*a* according to the comparative example at a location Z=−68 mm. The outside diameter of the cross-section is reduced by 1.8 mm, but the cross-section area of the cone part SC remains almost the same.

The following describes the inside and outside diameter, measured at Z=−68 mm, of the vertical coils in this embodiment and comparative example.

The deflection yoke related to the comparative example has a vertical deflection coil having an inside diameter of 21.5 mm and outside diameter of 23.0 mm, whereas the deflection yoke in this embodiment has a vertical deflection coil having an inside diameter of 19.5 mm and outside diameter of 21.0 mm. This means that both the inside and outside diameters of the vertical deflection coil in the embodiment can be reduced by 2.0 mm.

Also, inside diameters (diameter) of the ferrite cores in the embodiment and comparative example were measured at Z=−68 mm and they were 47 mm and 43 mm, respectively. This means that the inside diameter of the ferrite core in this embodiment can be reduced by 4 mm.

The deflection power at the time of a maximum deflection was measured for deflection yokes in this embodiment and the comparative example. The deflection power for the comparative example was 17.22 $mH \cdot A^2$ and that for the embodiment was 16.54 $mH \cdot A^2$. A The deflection yoke in this embodiment consumed deflection power 4 percent less than the deflection yoke related to the comparative example does.

Therefore, as described above, the bend part coils can be made thinner and the deflection power consumption can be reduced, making it easier to realize an energy-efficient color cathode-ray tube.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A deflection yoke used in a color cathode-ray tube, comprising:

a pair of horizontal deflection coils;

a pair of vertical deflection coils provided outside of the horizontal deflection coils with an insulating frame therebetween; and a deflection yoke core covering an outer surface of the vertical deflection coils, wherein each horizontal deflection coil includes a pair of cone parts, a screen-side bend part connecting the pair of cone parts facing towards a screen, and an electron gun-side bend part connecting the pair of cone parts facing towards an electron gun, the horizontal deflection coil being a bend-up-less saddle coil that is symmetrical with respect to a vertical plane that includes a tube axis and, the electron gun-side bend part has a protruding part protruding towards the electron gun, and each side of the protruding part, in a direction perpendicular to the tube axis, is located at a point so that a perpendicular line drawn from the point to the tube axis forms an angle of 10° to 50° inclusive with the vertical plane.

2. The deflection yoke of claim 1, wherein the protruding part of the horizontal deflection coil is formed by press molding.

3. The deflection yoke of claim 1, wherein the protruding part has a rectangular shape as viewed in a direction perpendicular to the tube axis along the vertical plane.

4. The deflection yoke of claim 1, wherein the protruding part is no less than 3 mm in length.

5. The deflection yoke of claim 1, wherein each vertical deflection coil includes a pair of cone parts, a screen-side bend part connecting the pair of cone parts facing towards the screen, and an electron gun-side bend part connecting the pair of cone parts facing towards the electron gun, the vertical deflection coil being a bend-up-less saddle coil that is symmetrical with respect to a horizontal plane that includes the tube axis, and the electron gun-side bend part of the vertical deflection coil has a protruding part protruding towards the electron gun, and each side of the protruding part, in a direction perpendicular to the tube axis, is located at a point so that a perpendicular line drawn from the point to the tube axis forms an angle of 10° to 50° inclusive with the horizontal plane.

6. A deflection yoke used in a color cathode-ray tube, comprising:

a pair of horizontal deflection coils;

a pair of vertical deflection coils provided outside of the horizontal deflection coils with an insulating frame therebetween; and a deflection yoke core covering an outer surface of the vertical deflection coils, wherein each vertical deflection coil includes a pair of cone parts, a screen-side bend part connecting the pair of cone parts facing towards a screen, an electron gun-side bend part connecting the pair of cone parts facing towards an electron gun, the vertical deflection coil being a bend-up-less saddle coil that is symmetrical with respect to a horizontal plane that includes the tube axis, and the electron gun-side bend part has a protruding part protruding towards the electron gun, and each side of the protruding part, in a direction perpendicular to the tube axis, is located at a point so that a perpendicular line drawn from the point to the tube axis forms an angle of 10° to 50° inclusive with the horizontal plane.

7. The deflection yoke of claim 6, wherein the protruding part of the vertical deflection coil is formed by press molding.

8. The deflection yoke of claim 6, wherein the protruding part has a rectangular shape as viewed in a direction perpendicular to the tube axis along the horizontal plane.

* * * * *